US011384777B2

(12) United States Patent
Casey

(10) Patent No.: US 11,384,777 B2
(45) Date of Patent: Jul. 12, 2022

(54) DOUBLE-ACTING HYDRAULIC ACTUATOR WITH DIFFERENT PUMPS FOR EACH ACTUATION DIRECTION

(71) Applicant: Siemens Energy, Inc., Orlando, FL (US)

(72) Inventor: John Casey, Fort Collins, CO (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 17/261,610

(22) PCT Filed: Aug. 21, 2018

(86) PCT No.: PCT/US2018/047150
§ 371 (c)(1),
(2) Date: Jan. 20, 2021

(87) PCT Pub. No.: WO2020/040736
PCT Pub. Date: Feb. 27, 2020

(65) Prior Publication Data

US 2021/0262492 A1 Aug. 26, 2021

(51) Int. Cl.
*F15B 7/00* (2006.01)

(52) U.S. Cl.
CPC ..... *F15B 7/001* (2013.01); *F15B 2211/20515* (2013.01); *F15B 2211/20538* (2013.01); *F15B 2211/20576* (2013.01); *F15B 2211/27* (2013.01); *F15B 2211/625* (2013.01)

(58) Field of Classification Search
CPC ..... F15B 2211/20515; F15B 2211/27; F15B 2211/20538; F15B 2211/20576; F16K 31/122; F16K 31/1221; F16K 31/143
See application file for complete search history.

(56) References Cited

U.S. PATENT DOCUMENTS 4,274,438 A * 6/1981 La Coste ..... F01D 21/20 137/551
6,205,780 B1 * 3/2001 Zervas ..... F15B 11/08 60/421
7,516,613 B2 4/2009 Kadlicko
(Continued)

FOREIGN PATENT DOCUMENTS

CA 1177726 A 11/1984
CN 107989858 A 5/2018
(Continued)

OTHER PUBLICATIONS

US 9,841,036 B2, 12/2017, Chester (withdrawn)
(Continued)

*Primary Examiner* — Thomas E Lazo

(57) ABSTRACT

An actuator operable to move a valve stem between an opened position and a closed position includes a cylinder including an open side and a close side, the cylinder coupled to the valve stem, a first pump connected to the cylinder and operable to deliver a first high-pressure fluid to the open side of the cylinder to move the valve stem toward the opened position, and a second pump separate from the first pump, the second pump connected to the cylinder and operable to deliver a second high-pressure fluid to the close side of the cylinder to move the valve stem toward the closed position.

23 Claims, 4 Drawing Sheets

(56) References Cited

U.S. PATENT DOCUMENTS

| | | | | |
|---|---|---|---|---|
| 8,020,379 | B2 | 9/2011 | Kakino et al. | |
| 8,033,107 | B2 | 10/2011 | Tikkanen | |
| 9,180,764 | B2 | 11/2015 | Bauer et al. | |
| 9,683,585 | B2 | 6/2017 | Akiyama et al. | |
| 9,903,394 | B2 * | 2/2018 | Brahmer | F15B 13/024 |
| 2012/0055149 | A1 | 3/2012 | Vonderwell | |
| 2016/0061185 | A1 * | 3/2016 | Vad | F15B 13/0401 416/154 |
| 2017/0284388 | A1 | 10/2017 | Caldwell et al. | |

FOREIGN PATENT DOCUMENTS

| | | | | |
|---|---|---|---|---|
| CN | 108412826 | A | 8/2018 | |
| DE | 102013008047 | A1 | 11/2014 | |
| EP | 1288505 | A1 | 3/2003 | |
| EP | 1288507 | A2 | 3/2003 | |
| EP | 2328747 | A1 | 6/2011 | |
| EP | 2620655 | A1 * | 7/2013 | F01D 17/145 |
| EP | 2676036 | A1 | 12/2013 | |
| EP | 2770218 | A2 | 8/2014 | |
| EP | 2676036 | B1 * | 12/2014 | B30B 1/34 |
| JP | S578382 | A | 1/1982 | |
| JP | 2001214903 | A | 8/2001 | |
| JP | 5009846 | B2 | 8/2012 | |
| WO | 2010020427 | A1 | 2/2010 | |
| WO | 2012110259 | A1 | 8/2012 | |

OTHER PUBLICATIONS

PCT International Search Report and Written Opinion of the International Searching Authority dated May 23, 2019 corresponding to PCT Application No. PCT/US2018/047150 filed Aug. 21, 2018.

* cited by examiner

DOUBLE-ACTING HYDRAULIC ACTUATOR WITH DIFFERENT PUMPS FOR EACH ACTUATION DIRECTION

TECHNICAL FIELD

The present disclosure is directed, in general, to hydraulically-actuated valves, and more specifically to self-contained hydraulic valves and actuators.

BACKGROUND

Hydraulic actuators are commonly used in applications that require high levels of force, rapid movement, or both. Typical hydraulic actuators require a supply of high-pressure fluid that is provided by a remote, centralized source that provides high-pressure fluid to multiple actuators. Piping between the supply and the actuators can be expensive and can be a source for undesirable leakage.

SUMMARY

An actuator operable to move a valve stem between an opened position and a closed position includes a cylinder including an open side and a close side, the cylinder coupled to the valve stem, a first pump connected to the cylinder and operable to deliver a first high-pressure fluid to the open side of the cylinder to move the valve stem toward the opened position, and a second pump separate from the first pump, the second pump connected to the cylinder and operable to deliver a second high-pressure fluid to the close side of the cylinder to move the valve stem toward the closed position.

In another construction, an actuator operable to move a valve stem between an opened position and a closed position includes a cylinder including an open side and a close side, the cylinder coupled to the valve stem, a first pair of pumps connected to the cylinder and operable to deliver a first high-pressure fluid to the open side of the cylinder and to draw a first supply fluid from the close side of the cylinder to move the valve stem toward the opened position, and a second pair of pumps separate from the first pair of pumps, the second pair of pumps connected to the cylinder and operable to deliver a second high-pressure fluid to the close side of the cylinder and to draw a second supply fluid from the open side of the cylinder to move the valve stem toward the closed position.

In another construction, a method of operating an actuator includes connecting a cylinder having an open side and a closed side to a movable valve stem, operating a first pump to deliver a first high-pressure fluid to the open side of the cylinder to drive the movable valve stem toward an open position, and operating a second pump to deliver a second high-pressure fluid to the close side of the cylinder to drive the movable valve stem toward a closed position, the second pump separate from the first pump. The method also includes controlling the first pump and the second pump to operate in one of three modes comprising a first mode in which the first pump operates and the second pump is idle, a second mode in which the second pump operates and the first pump is idle, and a third mode in which the first pump and the second pump are idle.

The foregoing has outlined rather broadly the technical features of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Also, before undertaking the Detailed Description below, it should be understood that various definitions for certain words and phrases are provided throughout this specification and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

Figure 1:
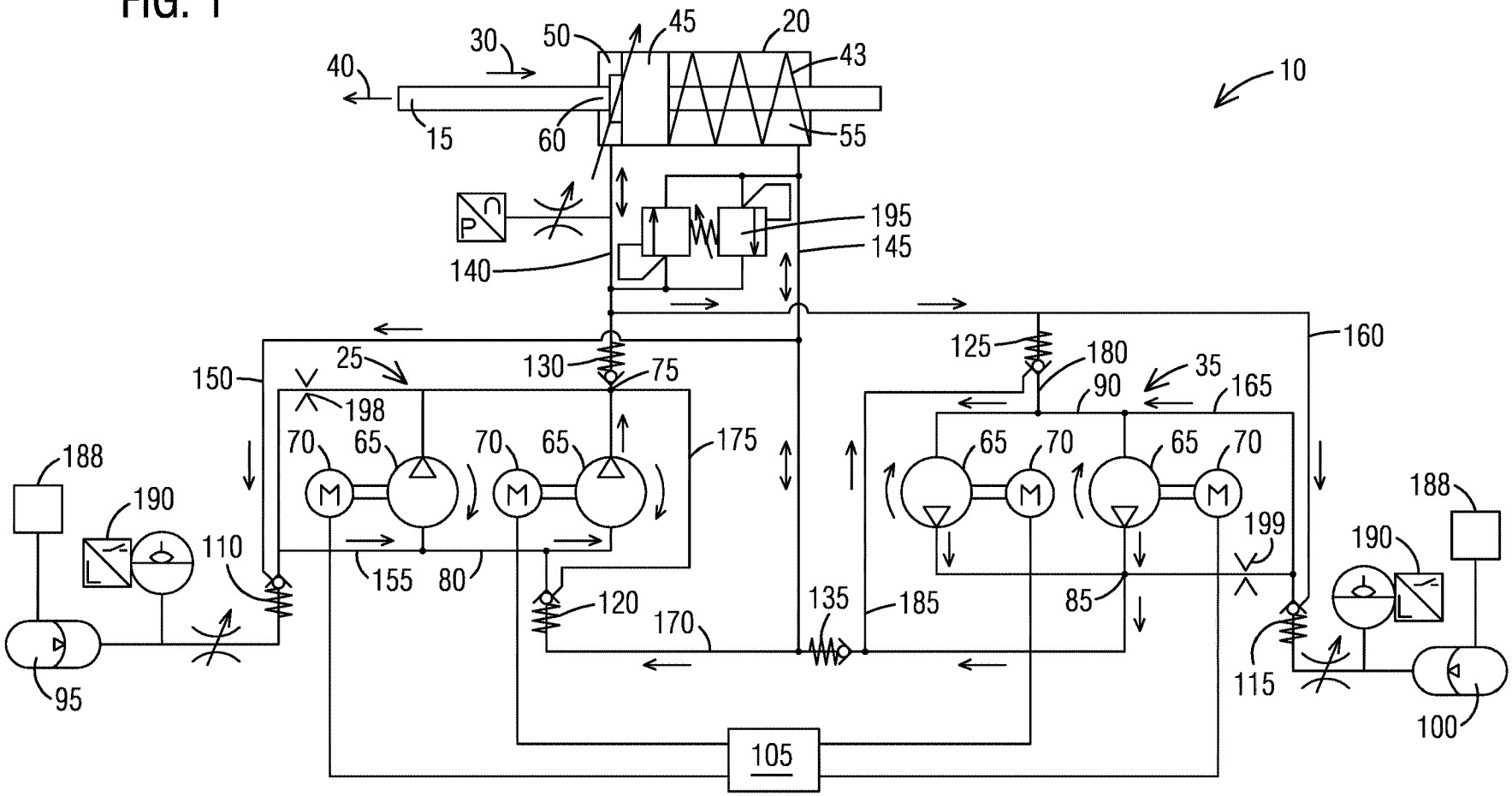
FIG. 1 is a schematic illustration of a self-contained hydraulic actuator.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard as available a variation of 20 percent would fall within the meaning of these terms unless otherwise stated.

FIG. 1 schematically illustrates a self-contained hydraulic actuator 10 that can be used to control movement of any number of devices including control valve stems 15, stop valves, vane positioners, etc. The actuator 10 includes a cylinder 20, a first pair of pumps 25 for moving the actuator 10 in a first direction 30, and a second pair of pumps 35 for moving the actuator 10 in a second direction 40 opposite the first direction 30.

The cylinder 20 in the illustrated construction is a double acting cylinder with a biasing member in the form of a spring return 43 and a cushion on the closing side of the cylinder 20. The cylinder 20 includes a movable piston 45 that divides the cylinder 20 into an open side 50 and a close side 55. A shaft 60 extends out of the cylinder 20 and connects to an object to be moved such as the control valve stem 15. The spring return 43 biases the piston 45 to one side of the cylinder 20. In constructions in which a valve is operated, the bias is typically toward a closed position. However, different applications may bias the device or valve toward an open position. The cushion is provided to allow fast movement in one direction without causing damage to the cylinder 20. While the illustrated cylinder 20 is a double acting cylinder with a biasing member and a cushion, other suitable cylinders could be single acting, and could omit or include any of the features discussed with regard to the cylinder 20. In addition, the cushion or biasing member could be positioned on the opposite ends of the cylinder or omitted if desired.

Figure 4:
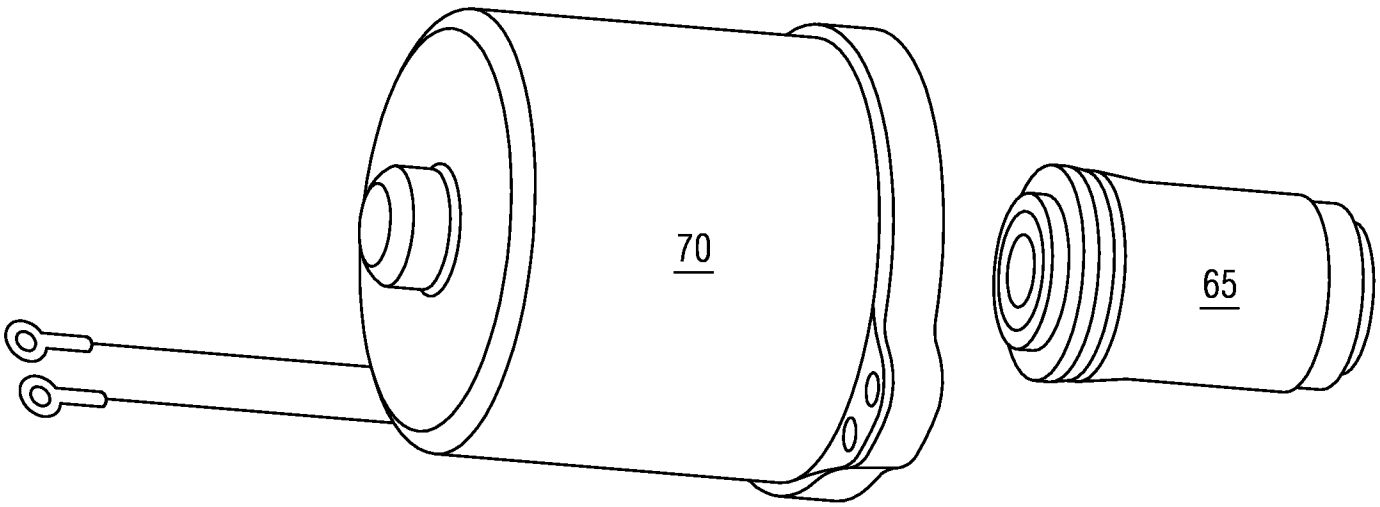
FIG. 4 is a perspective exploded view of a pump and motor.

The first pair of pumps 25 includes two substantially identical micro-piston pumps 65 as illustrated in FIG. 4. Each pump 65 is connected to a motor 70, and preferably a DC motor that is operated at a desired speed to provide the desired quantity of fluid. The illustrated pumps 65 are fixed displacement pumps 65 which are preferable as the volume of fluid delivered can be easily controlled by varying the speed of the motors 70. However, variable displacement pumps could also be employed if desired. The first pair of pumps 25 include an output 75 arranged to deliver a high-pressure fluid to the open side 50 of the cylinder 20 and an inlet 80 arranged to draw low-pressure fluid into the first pair of pumps 25.

The second pair of pumps 35 is substantially the same as the first pair of pumps 25 and includes two pumps 65 each connected to and driven by its own motor 70. The second pair of pumps 35 include an output 85 arranged to deliver a high-pressure fluid to the close side 55 of the cylinder 20 and an inlet 90 arranged to draw low-pressure fluid into the second pair of pumps 35. While the illustrated construction illustrates two pairs of pumps 25, 35, a single pump 65 for opening and a second single pump 65 for closing could be employed if desired. In addition, three or more pumps 65 could be employed in place of each pair of pumps 25, 35. Two or more pumps 65 for each of the open side 50 and close side 55 are preferred as it provides some redundancy in case one of the pumps 65 fails or does not operate properly.

In some constructions, each of the pumps 65 includes a check valve that inhibits reverse flow through the pump 65 when the pump is idle. Some pumps 65 may omit this check valve as their design itself inhibits such flow.

A first accumulator 95 is provided to collect or hold excess fluid and to deliver low pressure fluid to the first pair of pumps 25 as will be described. A second accumulator 100, similar to the first accumulator 95 is provided to collect or hold excess fluid and to deliver low pressure fluid to the second pair of pumps 35 as will be described. In some constructions, a single accumulator functions as the first accumulator 95 and the second accumulator 100.

A controller 105 (e.g., a PLC) communicates with each of the motors 70 to control their operation and speed. External controllers such as a turbine control or other control device can be used as the controller. Each pump 65 of the pairs of pumps 25, 35 are operated together and in one of three modes including a first or open mode 200 in which the first pair of pumps 25 operate while the second pair of pumps 35 are idle, a second or close mode 205 in which the second pair of pumps 35 operate while the first pair of pumps 25 are idle, and a third or maintain mode in which both the first pair of pumps 25 and the second pair of pumps 35 are idle. In the third mode of operation, the flow paths into or out of the cylinder 20 are blocked such that the cylinder 20, and the control valve stem 15 to which the cylinder 20 is attached remain fixed in their current position. Thus, the actuator 10 is able to selectively move the cylinder 20, and the control valve stem 15 or other component connected thereto to any point between an open position and a closed position.

Four pilot-operated check valves 110, 115, 120, 125 and two check valves 130, 135 are provided to control the flow of fluid within the self-contained actuator 10. The first check valve 130 is positioned in a first high-pressure line 140 between the output 75 of the first pair of pumps 25 and the open side 50 of the cylinder 20. The first check valve 130 is arranged to open in response to pressure being produced by the first pair of pumps 25 during operation to allow for the delivery of high-pressure fluid to the open side 50 of the cylinder 20. When the first pair of pumps 25 are not operating, the first check valve 130 moves to a closed position. The second check valve 135 is positioned in a second high-pressure line 145 between the output 85 of the second pair of pumps 35 and the close side 55 of the cylinder 20. The second check valve 135 is arranged to open in response to pressure being produced by the second pair of pumps 35 during operation to allow for the delivery of high pressure fluid to the close side 55 of the cylinder 20. When the second pair of pumps 35 are not operating, the second check valve 135 moves to a closed position. In some constructions, the pumps 65 each include a check valve that performs this function such that the check valve 135 is not needed.

The first pilot-operated check valve 110 is positioned between the first accumulator 95 and the inlet 80 of the first pair of pumps 25 to control access to the fluid within the first accumulator 95. A first pilot line 150 extends from the second high-pressure line 145 to the first pilot-operated check valve 110 to open the first pilot-operated check valve 110 in response to operation of the second pair of pumps 35. When the first pilot-operated check valve 110 opens, low-pressure fluid can fill a first suction line 155 that feeds fluid to the first pair of pumps 25. The second pilot-operated check valve 115 is positioned between the second accumulator 100 and the inlet 90 of the second pair of pumps 35 to control access to the fluid within the second accumulator 100. A second pilot line 160 extends from the first high-pressure line 140 to the second pilot-operated check valve 115 to open the second pilot-operated check valve 115 in response to operation of the first pair of pumps 25. When the second pilot-operated check valve 115 opens, low-pressure fluid can fill a second suction line 165 that feeds fluid to the second pair of pumps 35.

The third pilot-operated check valve 120 is positioned in a first connector line 170 that connects the second high-pressure line 145 to the first suction line 155. A third pilot line 175 extends from the first high-pressure line 140 to the third pilot-operated check valve 120 to open the third pilot-operated check valve 120 in response to high-pressure fluid flowing from the first pair of pumps 25. When the third pilot-operated check valve 120 opens, high-pressure is released from the first pilot line 150 which closes the first pilot-operated check valve 110 and cuts off any flow from the first accumulator 95 to the first pair of pumps 25. The close side 55 of the cylinder 20 is then connected through the third pilot-operated check valve 120 to the first suction line 155 such that fluid for the first pair of pumps 25 is drawn from the close side 55 of the cylinder 20 and delivered to the open side 50 of the cylinder 20 at high pressure.

The fourth pilot-operated check valve 125 is positioned in a second connector line 180 that connects the first high-pressure line 140 to the second suction line 165. A fourth pilot line 185 extends from the second high-pressure line 145 to the fourth pilot-operated check valve 125 to open the fourth pilot-operated check valve 125 in response to high-pressure fluid flowing from the second pair of pumps 35. When the fourth pilot-operated check valve 125 opens, high-pressure fluid is released from the second pilot line 160 which closes the second pilot-operated check valve 115 and cuts off any flow form the second accumulator 100 to the second pair of pumps 35. The open side 50 of the cylinder 20 is then connected through the fourth pilot-operated check valve 125 to the second suction line 165 such that fluid for the second pair of pumps 35 is drawn from the open side 50 of the cylinder 20 and delivered to the close side 55 of the cylinder 20 at high pressure.

Figure 2:
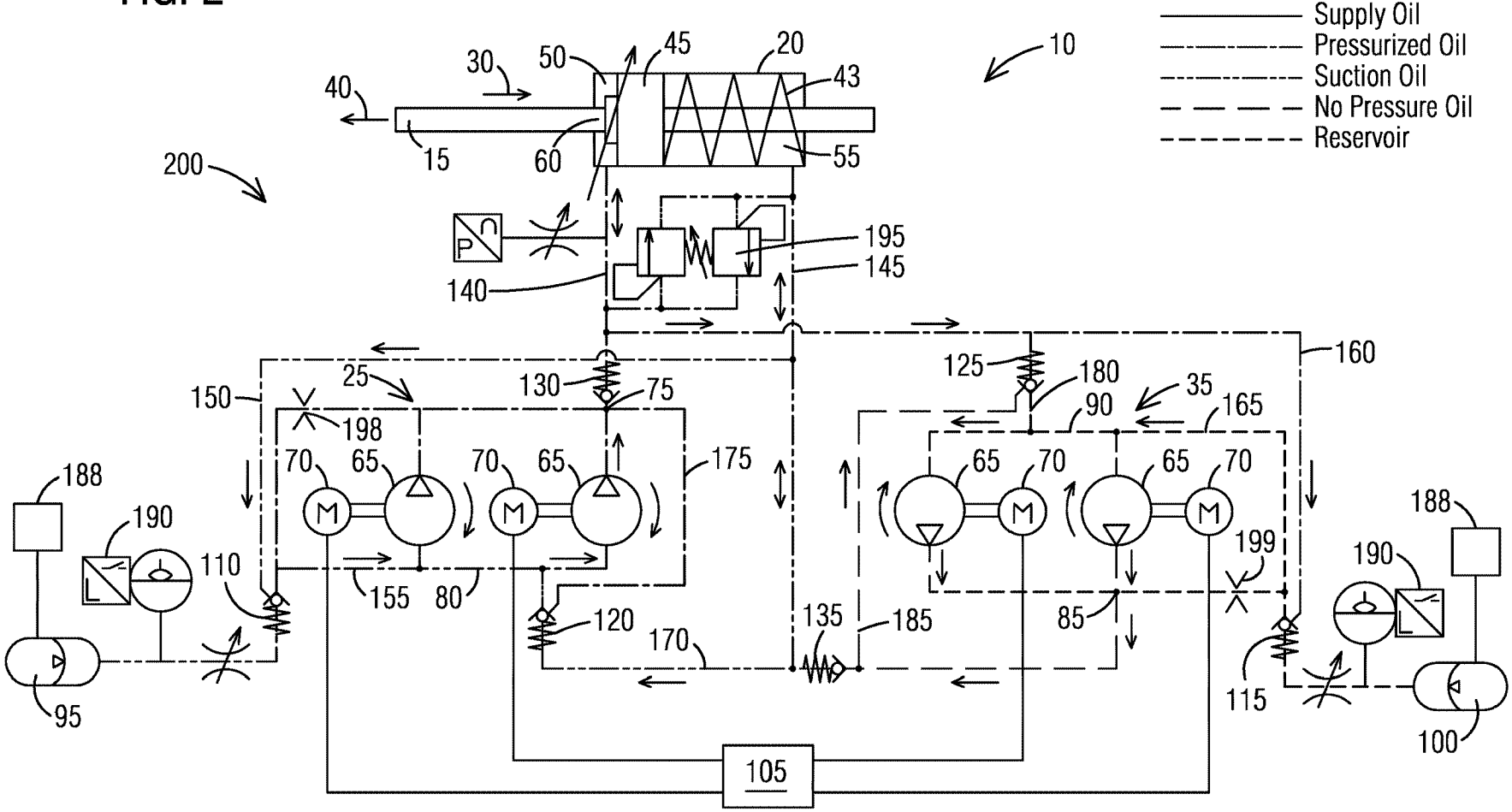
FIG. 2 is a schematic illustration of the self-contained hydraulic actuator of FIG. 1 in a first mode of operation.

FIG. 2 illustrates the first or open mode 200 of operation when the first pair of pumps 25 are operating to direct fluid to the open side 50 of the cylinder 20 and to move the control valve stem 15 toward the open position. High-pressure fluid flows from the output 75 of the first pair of pumps 25, fills the first high-pressure line 140 and flows into the open side 50 of the cylinder 20, in turn forcing the piston 45 to move toward the close side 55. High-pressure fluid also flows along the second pilot line 160 to the second pilot-operated check valve 115. The high-pressure fluid causes the second pilot-operated check valve 115 to open, thereby opening the second accumulator 100 to the second suction line 165 to allow the second pair of pumps 35 to draw fluid from the second accumulator 100 upon their start-up.

The first high-pressure line 140 is also connected to the third pilot-operated check valve 120 such that the high-pressure fluid within the first high-pressure line 140 opens the third pilot-operated check valve 120. With the third pilot-operated check valve 120 opened, the first suction line 155 is directly connected to the close side 55 of the cylinder 20 such that fluid is drawn from the close side 55 by the first pair of pumps 25, pressurized, and delivered to the open side 50 of the cylinder 20. When the third pilot-operated check valve 120 is opened, pressure in the first pilot line 150 is reduced and the first pilot-operated check valve 110 closes to inhibit fluid from flowing from the first accumulator 95 to the first pair of pumps 25. In preferred constructions, the third pilot-operated check valve 120 opens before the first check valve 130 opens to assure a supply of fluid is available to the first pair of pumps 25 during operation.

With continued reference to FIG. 2, the second pair of pumps 35 are in an idle state assuring that the second high-pressure line 145 is at a neutral or low pressure and the second check valve 135 is biased in its closed position. A small orifice 198 (0.01 GPM) or other passage may be provided between the third pilot line 175 and the first suction line 155. When the first pair of pumps 25 are in an idle position, the orifice 198 relieves pressure in the third pilot line 175 by directing high pressure fluid to the first suction line 155 and to the first accumulator 95 via the first pilot operated check valve 110 to assure that the third pilot operated check valve 120 closes. The fourth pilot-operated check valve 125 is also closed to assure that high-pressure fluid from the first pair of pumps 25 is not fed to the second suction line 165. The second pilot-operated check valve 115 is in the open position as noted such that the second accumulator 100 is in fluid communication with the second suction line 165.

Immediately upon starting the first pair of pumps 25, there is no pressure in the first high-pressure line 140. Without high-pressure from the first pair of pumps 25, the third pilot-operated check valve 120 is closed and the first pilot-operated check valve 110 is closed with an initial supply of fluid for the first pair of pumps 25 being disposed in the first suction line 155 after being supplied by the first accumulator 95. Once pressure is established in the first high-pressure line 140, the state of the third pilot-operated check valve 120 switches and fluid is drawn from the close side 55 of the cylinder 20 rather than the first accumulator 95.

For clarity, the following table illustrates the state of the various valves 110, 115, 120, 125, 130, 135 during operation in the first, or open mode 200 in which the first pair of pumps 25 are active.

| Valve | Normal Operation of First Pair of Pumps | Initial Start of First Pair of Pumps |
|---|---|---|
| First Check Valve 130 | Opened | Closed |
| Second Check Valve 135 | Closed | Closed |
| First Pilot-operated Check Valve 110 | Closed | Closed |
| Second Pilot-operated Check Valve 115 | Opened | Closed |
| Third Pilot-operated Check Valve 120 | Opened | Closed |

-continued

| Valve | Normal Operation of First Pair of Pumps | Initial Start of First Pair of Pumps |
|---|---|---|
| Fourth Pilot-operated Check Valve 125 | Closed | Closed |

Figure 3:
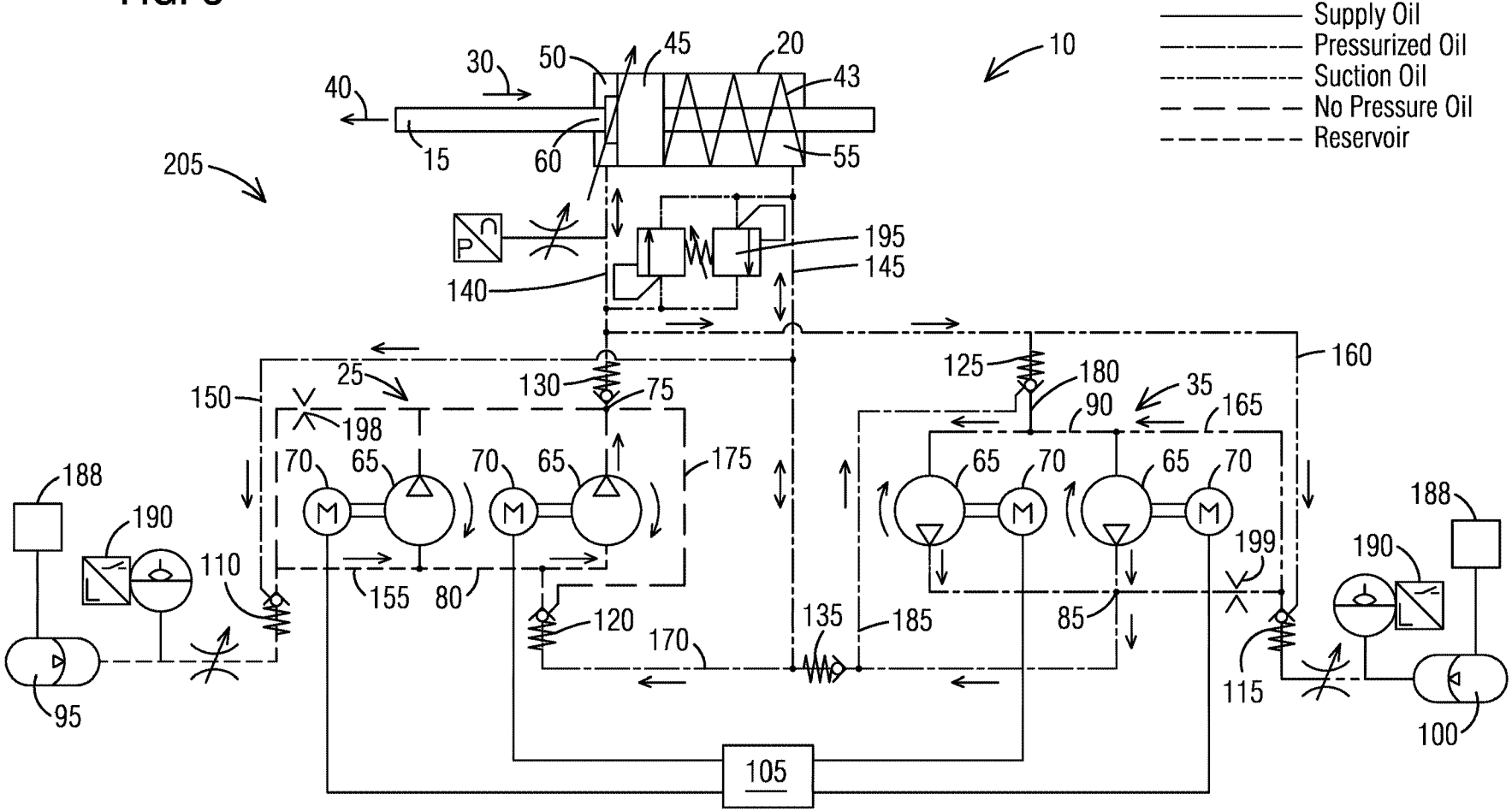
FIG. 3 is a schematic illustration of the self-contained hydraulic actuator of FIG. 1 in a second mode of operation.

Turning now to FIG. 3, the actuator 10 is illustrated during operation in the second mode in which the second plurality of pumps 35 are active to direct high-pressure fluid to the close side 55 of the cylinder 20 to move the control valve stem 15 toward a closed position.

With the second pair of pumps 35 in operation, the second high-pressure line 145 fills with high-pressure fluid, the second check valve 135 opens, and high-pressure fluid is directed along the first pilot line 150 and the fourth pilot line 185 to open the first pilot-operated check valve 110 and the fourth pilot-operated check valve 125 respectively. With the first pilot-operated check valve 110 open, the first suction line 155 is open to the first accumulator 95 to allow starting of the first pair of pumps 25.

The opening of the fourth pilot-operated check valve 125 exposes the second suction line 165 to the open side 50 of the cylinder 20, thereby allowing the second pair of pumps 35 to draw fluid from the open side 50 of the cylinder 20. Opening the fourth pilot-operated check valve 125 also removes pressure from the second pilot line 160 which allows the second pilot-operated check valve 115 to close to inhibit fluid flow from the second accumulator 100 to the second suction line 165. In preferred constructions, the fourth pilot-operated check valve 125 opens before the second check valve 135 opens to assure a supply of fluid is available to the second pair of pumps 35 during operation.

When the second pair of pumps 35 operate, the first pair of pumps 25 remain idle, thereby reducing the pressure in the first high-pressure line 140 such that the third pilot-operated check valve 120 closes. A small orifice 199 (0.01 GPM) or other passage may be provided between the fourth pilot line 185 and the second suction line 165. When the second pair of pumps 35 are in an idle position, the orifice 199 relieves pressure in the fourth pilot line 185 by directing high pressure fluid to the second suction line 165 and to the second accumulator 100 via the second pilot operated check valve 115 to assure that the fourth pilot operated check valve 125 closes.

Immediately upon starting the second pair of pumps 35, there is no pressure in the second high-pressure line 145. Without high-pressure from the second pair of pumps 35, the fourth pilot-operated check valve 125 is closed and the second pilot-operated check valve 115 is closed such that the initial supply of fluid to the second pair of pumps 35 comes from fluid disposed in the second suction line 165 that was added to the second suction line 165 by the second accumulator 100 prior to the closure of the second pilot-operated check valve 115. Once pressure is established in the second high-pressure line 145, the state of the fourth pilot-operated check valve 125 switches and fluid is drawn from the open side 50 of the cylinder 20 rather than the second accumulator 100.

For clarity, the following table illustrates the state of the various valves 110, 115, 120, 125, 130, 135 during operation in the second, or close mode 205 in which the second pair of pumps 35 are active.

| Valve | Normal Operation of Second Pair of Pumps | Initial Start of Second Pair of Pumps |
|---|---|---|
| First Check Valve 130 | Closed | Closed |
| Second Check Valve 135 | Opened | Closed |
| First Pilot-operated Check Valve 110 | Opened | Closed |
| Second Pilot-operated Check Valve 115 | Closed | Closed |
| Third Pilot-operated Check Valve 120 | Closed | Closed |
| Fourth Pilot-operated Check Valve 125 | Opened | Closed |

In operation, the controller 105 or control system operates to control the control valve stem 15 or other device being controlled by the actuator 10. In one example, the control valve stem 15 is a control valve stem 15 for a control valve in a steam turbine. The control system monitors speed or load and adjusts the position of the control valve stem 15 to achieve a desired speed or load. If the control system determines that the position of the control valve stem 15 needs to change, a signal is sent to the appropriate pair of pumps 25, 35 to activate the pair of pumps and to set a desired speed of operation. The speed of operation of the pair of pumps 25, 35 controls the rate of flow of fluid to the cylinder 20 and therefore controls the speed at which the control valve stem 15 moves. If the control valve is being opened, the first pair of pumps 25 operate and the valves 110, 115, 120, 125, 130, 135 are configured as illustrated and described with regard to FIG. 2. If the control valve is being closed, the second pair of pumps 35 operate and the valves 110, 115, 120, 125, 130, 135 are configured as illustrated and described with regard to FIG. 3.

In one construction, a programmable logic controller (PLC) is used to drive the motors 70 at the desired speed. In preferred constructions, pulse width modulation (PWM) is used to vary the speed of the motors 70.

During operation, some fluid inevitably leaks from the actuator 10 or is otherwise lost. As illustrated in FIGS. 1-3, each of the first accumulator 95 and the second accumulator 100 includes a reservoir 188 and a level switch 190 that allows for the addition of fluid to the actuator 10 should such additions be necessary. In some actuators, a single reservoir 188 feeds both the first accumulator 95 and the second accumulator 100.

FIGS. 1-3 also illustrate a relief valve 195 that is coupled to both the open side 50 and the close side 55 of the cylinder 20. The relief valve 195 operates to drain high-pressure fluid should a predetermined pressure be reached or exceeded within the cylinder 20.

While the actuator 10 is described as using DC motors 70, other motors such as AC, brushless DC, or switched reluctance motors could also be employed if desired.

While the constructions described with regard to FIGS. 1-3 include check valves and pilot operated check valves, other types of valves could be used in place of the check valves and the pilot operated check valves. As such, the invention should not be limited to constructions that include only check valves and the pilot operated check valves. For example, solenoid-operated valves could be employed in place of or in conjunction with the check valves and the pilot operated check valves.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. An actuator operable to move a valve stem between an opened position and a closed position, the actuator comprising:

a cylinder including an open side and a close side, the cylinder coupled to the valve stem;

a first pump connected to the cylinder and operable to deliver a first high-pressure fluid to the open side of the cylinder to move the valve stem toward the opened position; and a second pump separate from the first pump, the second pump connected to the cylinder and operable to deliver a second high-pressure fluid to the close side of the cylinder to move the valve stem toward the closed position, wherein the first pump and the second pump are fixed displacement pumps, and wherein the first pump is a micro-piston pump.

2. The actuator of claim 1, wherein the cylinder includes a double acting cylinder with a biasing member positioned to bias the valve stem toward the closed position.

3. The actuator of claim 1, wherein the first pump includes a first pair of pumps and the second pump includes a second pair of pumps.

4. The actuator of claim 1, further comprising a first DC motor coupled to the first pump to drive the first pump, and a second DC motor coupled to the second pump to drive the second pump.

5. The actuator of claim 4, further comprising a controller connected to the first motor and the second motor, the controller operable to activate one of the first motor and the second motor to selectively move the valve stem toward one of the opened position and the closed position.

6. The actuator of claim 5, wherein the controller is operable to vary a speed of the first motor and the second motor between a low speed and a high speed to control a speed of movement of the valve stem as it moves toward one of the opened position and the closed position.

7. The actuator of claim 6, wherein the controller uses pulse width modulation (PWM) to control the speed of the first motor and the second motor.

8. An actuator operable to move a valve stem between an opened position and a closed position, the actuator comprising:

a cylinder including an open side and a close side, the cylinder coupled to the valve stem;

a first pump connected to the cylinder and operable to deliver a first high-pressure fluid to the open side of the cylinder to move the valve stem toward the opened position; and a second pump separate from the first pump, the second pump connected to the cylinder and operable to deliver a second high-pressure fluid to the close side of the cylinder to move the valve stem toward the closed position, wherein the first pump draws a first supply of fluid from the close side of the cylinder to deliver the first high-pressure fluid to the open side, and the second pump draws a second supply of fluid from the open side of the cylinder to deliver the second high-pressure fluid to the close side.

9. An actuator operable to move a valve stem between an opened position and a closed position, the actuator comprising:

a cylinder including an open side and a close side, the cylinder coupled to the valve stem;

a first pair of pumps connected to the cylinder and operable to deliver a first high-pressure fluid to the open side of the cylinder and to draw a first supply fluid from the close side of the cylinder to move the valve stem toward the opened position; and a second pair of pumps separate from the first pair of pumps, the second pair of pumps connected to the cylinder and operable to deliver a second high-pressure fluid to the close side of the cylinder and to draw a second supply fluid from the open side of the cylinder to move the valve stem toward the closed position.

10. The actuator of claim 9, wherein the cylinder includes a double acting cylinder with a biasing member positioned to bias the valve stem toward the closed position.

11. The actuator of claim 9, wherein each pump of the first pair of pumps and the second pair of pumps is a fixed displacement pump.

12. The actuator of claim 11, wherein each pump is a micro-piston pump.

13. The actuator of claim 9, further comprising a first pair of DC motors with each motor coupled to one of the pumps of the first pair of pumps to individually drive each pump of the first pair of pumps, and a second pair of DC motors with each motor coupled to one of the pumps of the second pair of pumps to individually drive each pump of the second pair of pumps.

14. The actuator of claim 13, further comprising a controller connected to the first pair of motors and the second pair of motors, the controller operable to activate one of the first pair of motors and the second pair of motors to selectively move the valve stem toward one of the opened position and the closed position.

15. The actuator of claim 14, wherein the controller is operable to vary a speed of each motor of the first pair of motors and the second pair of motors between a low speed and a high speed to control a speed of movement of the valve stem as it moves toward one of the opened position and the closed position.

16. The actuator of claim 15, wherein the controller uses pulse width modulation (PWM) to control the speed of each motor of the first pair of motors and the second pair of motors.

17. The actuator of claim 9, further comprising a first accumulator coupled to the first pair of pumps and operable to deliver the first supply fluid during initial operation of the first pair of pumps.

18. The actuator of claim 17, further comprising a second accumulator coupled to the second pair of pumps and operable to deliver the second supply fluid during initial operation of the second pair of pumps.

19. A method of operating an actuator, the method comprising:

connecting a cylinder having an open side and a closed side to a movable valve stem;

operating a first pump to deliver a first high-pressure fluid to the open side of the cylinder to drive the movable valve stem toward an open position;

operating a second pump to deliver a second high-pressure fluid to the close side of the cylinder to drive the movable valve stem toward a closed position, the second pump separate from the first pump;

controlling the first pump and the second pump to operate in one of three modes comprising a first mode in which the first pump operates and the second pump is idle, a second mode in which the second pump operates and the first pump is idle, and a third mode in which the first pump and the second pump are idle.

20. The method of claim 19, further comprising drawing a first supply fluid from a first accumulator upon initial activation of the first pump and then subsequently drawing the first supply fluid from the close side of the cylinder.

21. The method of claim 20, further comprising drawing a second supply fluid from a second accumulator upon initial activation of the second pump and then subsequently drawing the second supply fluid from the open side of the cylinder.

22. The method of claim 19, further comprising providing a first DC motor coupled to the first pump to drive the first pump and a second DC motor coupled to the second pump to drive the second pump, and operating a controller to control a speed and an operational state of the first DC motor and the second DC motor.

23. The method of claim 22, further comprising using PWM to control the speed of each of the first motor and the second motor.

* * * * *